United States Patent [19]

Pope

[11] Patent Number: 4,514,903

[45] Date of Patent: May 7, 1985

[54] PERSONAL GROOMING DEVICE

[76] Inventor: H. Maie' Pope, Boardwalk Apartment Bldg., 4343 N. Clarendon Ave., Chicago, Ill. 60613

[21] Appl. No.: 551,352

[22] Filed: Nov. 14, 1983

[51] Int. Cl.[3] ..... B26B 21/00

[52] U.S. Cl. ..... 30/49; 30/32

[58] Field of Search ..... 30/30, 32, 49

[56] References Cited

U.S. PATENT DOCUMENTS

| | | | |
|---|---|---|---|
| 1,059,016 | 4/1913 | Williams | 30/32 |
| 1,201,317 | 10/1916 | Lishawa | 30/32 X |
| 1,735,140 | 11/1929 | Speirs | 30/49 |
| 1,792,415 | 2/1931 | Dean | 30/49 |
| 1,864,995 | 6/1932 | Frost | 30/32 |
| 2,069,465 | 2/1937 | Wallenbeck | 30/49 |
| 2,127,010 | 8/1938 | Sampson | 30/32 |
| 2,547,376 | 4/1951 | Crawford | 30/32 |

*Primary Examiner*—Jimmy C. Peters

*Attorney, Agent, or Firm*—Jerry A. Schulman; Ronald A. Sandler

[57] ABSTRACT

A trimmer for eyebrows and other facial hair has relatively thin blade segments held by a thermoplastic fingergrip in an angled or "bent" configuration. The exposed, longitudinally extending edge of the blade segments are honed or otherwise sharpened and are used to position one such segment to sever selected facial hair while angling the other segments away from the face.

9 Claims, 4 Drawing Figures

PERSONAL GROOMING DEVICE

BACKGROUND OF THE INVENTION

This application relates generally to the field of cosmetic grooming aids and devices and, more particularly, to an implement for shaping and trimming eyebrows.

Beauticians have long faced inherent difficulties presented when trimming and shaping the eyebrows of their customers. Use of tweezers to pluck unwanted hairs is old and well known, but this method is extremely time-consuming and causes a significant amount of pain and discomfort. A preferred manner of trimming is to sever the hairs rather than plucking them.

One difficulty in severing brow hairs is the need to use a trimming device with extremely sharp cutting surfaces to sever the hairs of the brow while avoiding contact with the soft, easily cut skin of the face. Another reason such difficulty obtains is the location of the brows in close proximity to the eyes, and the care which must be exercised to avoid injurious contact with the eyelid or the eye itself. Yet another problem is encountered in making such a trimmer small enough to be maneuvered around the eyes and brows, yet shaped to allow the trimmer to be easily and firmly held and effectively manipulated.

Prior trimming devices of which I am aware do not fully meet these problems. For example, straight razor blades are commonly used for brow trimming even though such blades typically have extended straight cutting edges which are long relative to the size of the brow and/or eyes, frequently requiring the razor blade to be angled away from the face when following a brow's contour or the contour of the face itself. This moves the cutting edge of the razor blade to a position which does not parallel the brow and makes it difficult to achieve a smooth, continuous cut. Maneuvering the blade to bring one corner of the cutting edge in contact with the brow may angle the other corner of the cutting edge in a position to inadvertently cut the hand or finger of the user or, if moved suddenly, to cut the face itself.

Many such straight razor blades are double edged, making manipulation of the blade even more hazardous. It is, therefore, the straightness and size of the blade and the length of the cutting edge which make the blade manifestly ill-suited for trimming eyebrows. On the other hand, even though the size and straightness of the blade causes problems, the sharpness of the blade and the ease with which the relatively limp and yielding eyebrow hairs may be cut by it, give the use of a razor or razor-like cutting edge particular utility.

The foregoing problems are exacerbated when prior trimmers are manipulated by the user, rather than by a beautician. The user relies principally upon observing his or her image in a mirror to guide the trimming operation and with the disadvantages discussed hereinabove, it is often the case that the user's hand, in which the razor is placed, itself blocks a clear view of the brow. Another problem to be overcome is the fact that the user is working with a mirror image, making manipulation of prior trimming devices less certain and making any mistake or potential mistake more serious.

The need, therefore, exists for a cutting or trimming implement preserving the utility of a razor-like edge, yet of a size and shape to allow the easy and effective manipulation of the cutting edge in order to effectively and conveniently trim a brow. These, and further objects of the present invention will better be understood by consideration of the accompanying drawings, wherein:

DETAILED DESCRIPTION OF THE INVENTION

An eyebrow trimmer is formed into distinct segments, with each segment formed at an angle to the immediately contiguous segment. The trimmer has a relatively narrow metal strip or blade and a pair of opposed, longitudinally-extending edges formed therealong. One such edge is ground, honed, or otherwise formed into a cutting edge of razor-like sharpness.

The non-sharpened of said longitudinally-extending edges is mounted or embedded into a finger-grip portion formed to hold or maintain angled bends in the blade and shaped to allow easy manipulation of the cutting edge of the blade while maintaining a firm grip. The blade, in a preferred embodiment, has a series of equidistantly-spaced apertures formed therealong for purposes of cleaning.

DETAILED DESCRIPTION OF THE DRAWINGS

Figure 1:
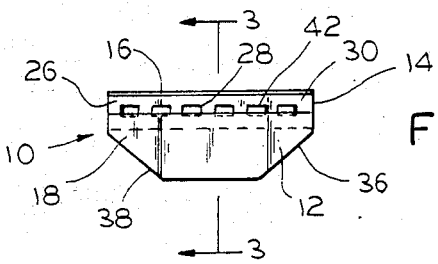
FIG. 1 is a front elevation of a device embodying the invention disclosed herein.

Referring now to FIG. 1, the numeral 10 indicates generally a preferred embodiment of an implement constructed according to the above-disclosed aspects of the present invention. As seen in FIG. 1, implement 10 has a handgrip portion 12 and a cutting edge or blade 14. As described hereinabove, blade 14 is preferably formed from a long, relatively narrow metal strip having a pair of longitudinally opposed and extending edges 16 and 18. In the embodiment herein shown, at least edge 16 is ground, honed, or otherwise formed to produce a razor-like edge.

Figure 2:
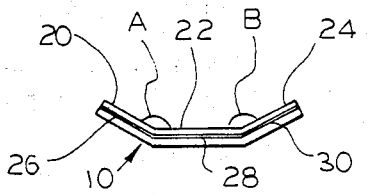
FIG. 2 is a top view of the device shown in FIG. 1.

In FIG. 2, a top view of implement 10, handgrip 12 is shown as formed from three contiguous and integral segments 20, 22, and 24, with central segment 22 meeting its contiguous partners 20 and 24 at angles A and B, respectively. In like fashion, cutting blade 14 is similarly formed with segments 26, 28, and 30 in a configuration which closely matches that of handgrip 12.

Figure 3:
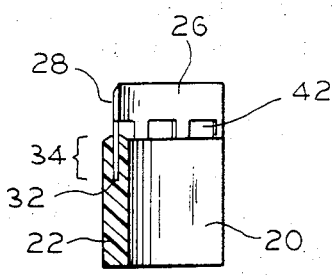
FIG. 3 is a view along lines 3—3 of FIG. 1.

In FIG. 3, a view along lines 3—3 of FIG. 1, implement 10 is shown in section illustrating the relative bend of cutting blade segment 26 with respect to segment 28. In like fashion, the relative bend of handgrip segment 20 with respect to segment 22 is also illustrated.

Also shown in FIG. 3 is a preferred manner of securing cutting blade 14 to handgrip 12 by embedding edge 18 of blade 14 within a channel 32 formed along segments 20, 22, and 24 of handgrip 12 and sized to closely fit a sufficiently deep segment 34 of cutting blade 14 to hold cutting blade 14 within handgrip 12 in a mechanical or friction fit. Glues, cements, or mechanical fasteners may also be used to secure blade 14 to handgrip 12.

As further seen in FIG. 1, handgrip 12 may be shaped or trimmed as at 36 and 38, leaving central segment 22 fully extending. It is contemplated that a user, when manipulating or guiding implement 10 will find it convenient and comfortable to guide implement 10 by pressing a finger along edges 36 or 38 and also partially within the bend formed by handgrip segments 20, 22, and 24.

Mounting a sharpened razor-like metal strip in a plastic or plastic-like holder is well known. However, such holders do not, to my knowledge, teach the angling of continuous segments in order to expose the cutting edge for trimming purposes and to angle the segment containing cutting edges away one from the other to more conveniently and effectively limit contact of the cutting edge only to those segments of the face or brows sought to be trimmed. As an example, it is known to mount razor blades for the shaving of facial hair into plastic carriers or holders, but in unsegmented configurations.

Figure 4:
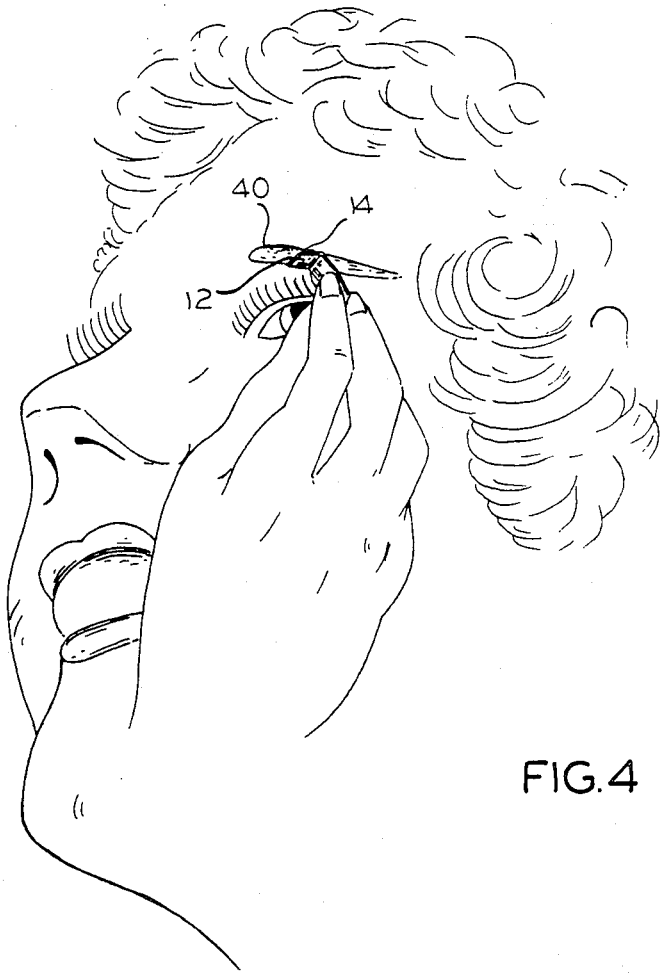
FIG. 4 is an illustration demonstrating use of the present invention.

Referring now to FIG. 4, use of the preferred embodiment hereinabove discussed is illustrated. The user may grip handgrip 12 to angle a portion of blade 14 in position to trim and contact brow 40 along its uppermost edge thereof, while the remaining segments of blade 14 are angled away from the user's face. Implement 10 may also be reversed or inserted when used, for example, on different sides of the face or when the implement is shifted from one hand to the other.

As seen in FIGS. 1 and 3, a series of longitudinally-spaced apertures 42 may be formed along blade 14 to lighten blade 14 and to provide courses for cleansing water to flush away brow hair and other material removed during the trimming process.

Another preferred embodiment would limit the existance of the cutting edge 16 to, for example, wing segments 26 and 30 of blade 14. This would be done where the central segment 28 of blade 14 would not be intended for use during cutting and trimming.

In its preferred embodiment, angles A and B are identical, producing an implement which is symmetrically formed. Angles A and B may differ, however, if desired.

As presently contemplated, fingergrip 12 may be formed from a relatively easily molded thermoplastic material which when cast or molded, and thereafter cooled or cured. Insertion of blade 14 to fingergrip 12 may be carried out during the molding process or thereafter, as the practicalities and economies of the manufacturing process dictate. Where fingergrip 12 is cast or molded around the metal strip 14, apertures 42 form sites for attachment where the materail used to form fingergrip 12 flows there through prior to setting or curving. Although the present implement is intended for use as a unitary structure, it could be discarded when the blade 14 dulls, it is also contemplated that a more elaborate structure may be utilized for fingergrip 12 to enable removal of blade 14 and replacement by a fresh blade. Such structure may also allow both edges 16 and 18 to be sharpened, and to allow blade 14 to be removed and reversed when one such edge dulls.

The foregoing construction is lighter in weight and more easily manipulated than the prior art razors discussed herein.

While the foregoing has presented certain specific embodiments of the present invention, it is to be understood that these embodiments have been presented by way of example only. It is expected that others will perceive variations which, while differing from the foregoing, do not depart from the spirit and scope of the invention as herein described and claimed.

What is claimed is:

1. A cutter for trimming and shaping facial hair, said cutter comprising:

a relatively narrow metal blade having a pair of longitudinally extending and opposed edges, the first of said edges being honed or sharpened;

a fingergrip for said blade, said fingergrip engaging said blade at said second edge thereof and over a portion of said strip towards said first edge, said first or sharpened edge remaining exposed when said blade is engaged by said handgrip, said handgrip having a central segment and a pair of longitudinally-extending wing segments integral therewith, said wing segments being angled or inclined one toward the other, said blade being thereby held in an angled or inclined attitude approximating that of said handgrip.

2. The apparatus as recited in claim 1 wherein said wing segments meets said central segment at identical angles.

3. The apparatus as recited in claim 1 wherein said metal blade has a plurality of apertures spaced longitudinally therealong.

4. The apparatus as recited in claim 3 wherein at least a portion of said apertures are overlapped by said fingergrip.

5. The apparatus as recited in claim 1 including means for retaining said blade in said fingergrip.

6. The apparatus as recited in claim 5 wherein said retaining means includes means for selectively inserting and removing such blade to and from said fingergrip.

7. The apparatus as recited in claim 6 wherein both said blade edges are honed or sharpened.

8. The apparatus as recited in claim 1 wherein said first edge is sharpened only along said portion of said metal blade held by said wing segments.

9. The apparatus as recited in claim 1 wherein a portion of at least one said fingergrip wing segment is trimmed away to form an angled gripping edge.

* * * * *